United States Patent [19]

Kaufman et al.

[11] Patent Number: 4,461,973

[45] Date of Patent: Jul. 24, 1984

[54] ENERGY-EFFICIENT INCANDESCENT LAMP WITH IMPROVED FILAMENT CHARACTERISTICS

[75] Inventors: Rudolph Kaufman, North Bergen; Wolfgang E. Thouret, Verona, both of N.J.

[73] Assignee: Duro-Test Corporation, North Bergen, N.J.

[21] Appl. No.: 359,743

[22] Filed: Mar. 19, 1982

[51] Int. Cl.[3] ..... H01J 7/44; H01J 17/34; H01J 19/78; H01J 29/96

[52] U.S. Cl. ..... 315/56; 313/112; 315/58; 315/200 R

[58] Field of Search ..... 315/56, 58, 200; 313/112

[56] References Cited

U.S. PATENT DOCUMENTS

| | | | |
|---|---|---|---|
| 2,859,369 | 11/1958 | Williams et al. | 313/112 |
| 3,062,986 | 11/1962 | Fritz et al. | 315/200 |
| 3,818,263 | 6/1974 | Belko | 315/200 |
| 3,823,339 | 7/1974 | Boreman et al. | 315/200 |
| 3,869,631 | 3/1975 | Anderson et al. | 315/200 |
| 4,160,929 | 7/1979 | Thorington et al. | 313/112 |

*Primary Examiner*—Saxfield Chatmon
*Attorney, Agent, or Firm*—Darby & Darby

[57] ABSTRACT

An energy-efficient incandescent lamp has a transparent heat mirror placed on the envelope. A diode is connected in series with the filament. This reduces the voltage across the filament and increases the current passing through it, so that shorter and greater diameter filament wire is used. This makes a stronger filament than is used in a conventional incandescent lamp with no diode, and makes the filament more resistant to displacement by mechanical forces.

7 Claims, 3 Drawing Figures

ENERGY-EFFICIENT INCANDESCENT LAMP WITH IMPROVED FILAMENT CHARACTERISTICS

This invention pertains to incandescent lamps, and particularly to incandescent lamps of the type which use a transparent heat mirror.

It is already known to provide an incandescent lamp with a transparent heat mirror that reflects infrared radiation back to the filament while permitting visible radiation to pass out of the lamp. This is taught, for example, in U.S. Pat. No. 4,160,929 and in other patents.

Incandescent lamps with transparent heat mirrors are precise optical devices. It is desirable to situate the incandescent filament as precisely as possible with respect to the optical center of the envelope or other surface on which a transparent heat mirror is placed. Should the filament be, for example designed to pass through the optical center of the envelope, if it is displaced therefrom as a result of vibration or other cause, the resulting optical aberration will interfere with the efficiency of the lamp.

As an incandescent filament is made shorter and of larger diameter wire, its mechanical strength increases. This tends to prevent the filament from being displaced by mechanical forces acting on the lamp. For example, in automotive reflector-type incandescent lamps which operate at low voltages and high currents, precise positioning of the filament is maintained even under the severe vibration conditions of automotive use.

For an incandescent lamp of a given wattage, a lamp that operates at lower voltages and higher currents utilizes a filament which is shorter and of greater diameter wire than one used in a lamp operated at higher voltages and lower currents. Additionally, it is known from U.S. Pat. No. 3,869,631 that when a diode is placed in series with the filament of an incandescent lamp, the AC line voltage will be rectified and reduced to a lesser voltage of pulsating DC, necessitating a larger diameter filament wire for a lamp of the same wattage.

According to the invention, an incandescent lamp having a transparent heat mirror is provided which resists degradation of optical performance caused by vibration.

The lamp of the invention has a semiconductor diode connected in series with the filament. This rectifies the AC supply voltage which operates the lamp and produces pulsating DC of lesser voltage. Since the voltage across the filament is reduced, a thicker, shorter, and more mechanically rigid filament is used in the lamp. This in turn provides a lamp of the type having a transparent heat mirror with a filament that is more resistant to mechanical shock.

It is therefore an object of the invention to provide an incandescent lamp of the transparent heat mirror type which resists optical degradation caused by mechanical forces.

It is another object to provide such a lamp in which a semiconductor diode is connected in series with the filament.

It is still another object to provide such a lamp in which the diode acts as a fuse that protects a fixture in which the lamp is installed.

BRIEF DESCRIPTION OF THE DRAWINGS

The drawings show preferred, but nonetheless merely illustrative, embodiments of the invention, in which.

DETAILED DESCRIPTION OF PREFERRED EMBODIMENTS

Figure 1:
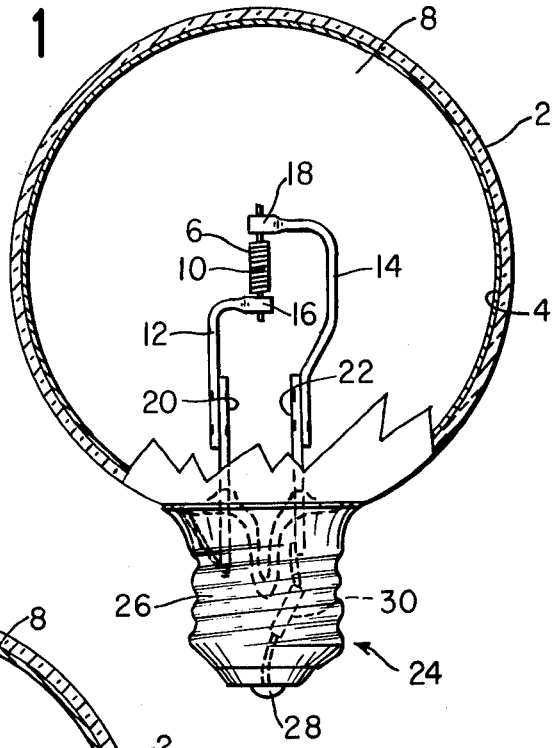
FIG. 1 shows a side view of a first embodiment of the invention, partially in section.

An envelope generally indicated by reference numeral 2 is spherical and made of any suitable transparent vitreous material, such as lime glass. While envelope 2 is spherical as shown in this example, it can be, e.g., elliptical, cylindrical, etc. The particular shape of envelope 2 is not critical to the invention.

A multilayer filter coating 4 is placed on the inner surface of envelope 2 and serves as a transparent heat mirror. Filter coating 4 may be of the type taught in U.S. Pat. No. 4,160,939 or may be of any other suitable type, such as all-dielectric or all-semiconductor. The particular multilayer filter coating 4 used is not part of the invention. Filter coating 4 may also be located on the outside of envelope 2.

A coiled filament 6 is located within envelope 2. As shown, filament 6 is vertically mounted and its center is at the optical center 10 of the envelope. Filament 6 may be of tungsten or doped tungsten, and of the single coil, coiled coil, or triple coil type. The material, mounting direction, and shape of filament 6 are not critical to the invention.

In this example, optical center 10 is a point at the center of envelope 2, but this may be varied. For example, if envelope 2 is cylindrical, the reflective foci of the envelope would be a line segment at the center of the cylinder 2. If envelope 2 is elliptical, the foci of the envelope would be two discrete points. It is not necessary that filament 6 always be located on an optical focal point or line of the envelope. Filament 6 may be offset from the optical focal point or line by a predetermined amount. However, it should be fixed precisely with respect to optical center 10, whether or not they coincide.

In this example, the ends of filament 6 are supported by support wires 12 and 14 respectively. Support wires 12 and 14 have flattened tabs 16 and 18 respectively to which the ends of filament 6 are welded or otherwise electrically secured. Conductors 20 and 22 (which is this example are formed of lengths of relatively thick wire) pass through envelope 2. Conductor 20 is spot-welded to wire 12 and conductor 22 is likewise spot-welded to wire 14, although other connections may be used or a single unitary element may be connected between each end of the filament 6 and the outside of envelope 2.

A threaded connector generally indicated by reference numeral 24 is located at the base of the lamp. Connector 24 has a conventional threaded terminal 26 which is connected to conductor 20. Connector 24 also has a conventional button terminal 28 on its bottom. Button terminal 28 is connected to one end of a semiconductor diode 30. The other end of semiconductor diode 30 is connected to conductor 22.

Semiconductor diode 30 in this example is a junction diode designed for series connection in one side of the lamp's AC line. Diode 30 will pass either a positive or negative half-cycle from the AC line depending on the way in which it is connected. When connected to a conventional 120 volt AC supply, filament 6 draws pulsating DC at approximately 83 volts RMS. Thus, to operate at a given wattage, the lamp will draw more current than will a conventional incandescent lamp of the same wattage that operates without a diode. For example, a conventional 100 watt incandescent lamp without a diode will draw about 0.82 amps while the lamp described will draw approximately 1.2 amps.

In this example, approximately 30% less voltage is applied across the filament and 45% greater current flows through it than in the case of a filament of a conventional 100 watt lamp. Filament 6 can therefore be approximately 30% shorter and can be made of wire which is approximately 45% larger in diameter than its counterpart in a conventional lamp with no diode. Filament 6 can thus resist mechanical shocks that might misalign the filaments of conventional lamps. In this example, it is only necessary to support filament 6 at its ends.

The current rating of semiconductor diode 30 is selected so that diode 30 will act as a fuse. Should a short circuit develop between supports 12 and 14 because filament 6 burns out, semiconductor diode 30 can be chosen to burn out when the current drawn by the lamp exceeds a predetermined amount, e.g., 1.5 amps in the embodiment described. This fuses the lamp and protects a fixture into which connector 24 is threaded.

Figure 2:
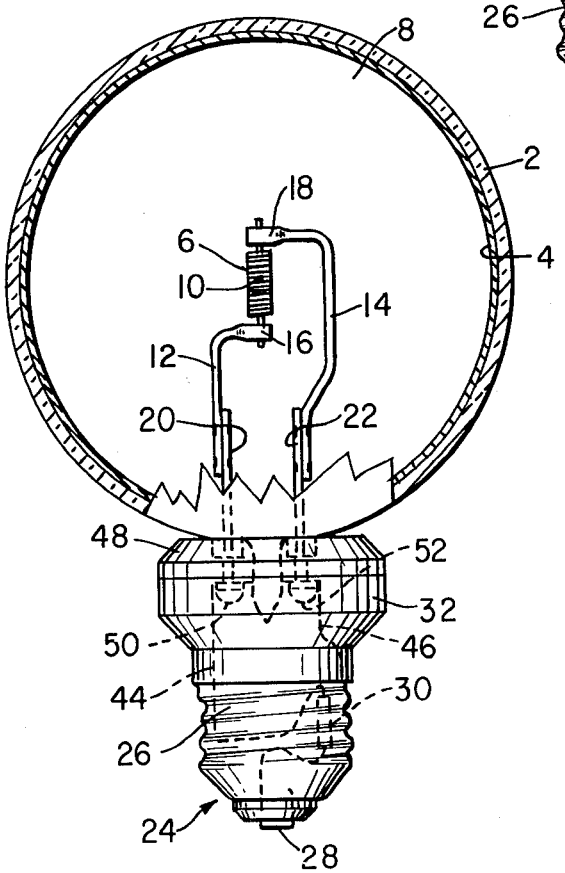
FIG. 2 shows a side view of a second embodiment of the invention, partially in section.
Figure 3:
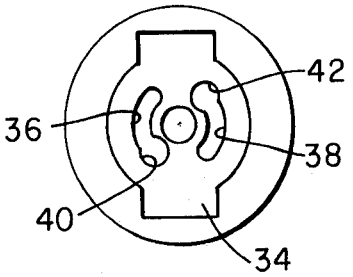
FIG. 3 shows a top view of an adapter which is used in the second embodiment.

In the example of FIG. 2, corresponding elements have corresponding identification numbers. This second example of the invention permits the semiconductor diode 30 to be reused if it has not burned out. In this second example, connector 24 is mounted to a support 32. Support 32 has a flat top 34, in which two arcuate and diametrically opposed keyhole slots 36 and 38 are located. Slots 36 and 38 terminate in opposed enlarged regions 40 and 42, respectively.

The end of diode 30 which is remote from button terminal 28 is electrically connected around slot 36 by conductive strip 44. Conductive strip 46 similarly connects threaded terminal 26 around slot 38.

The lower ends of conductors 20 and 22 are supported by a base 48. Base 48 mates with support 32, and the lower ends of conductors 20 and 22 are formed into enlarged heads 50 and 52 respectively. When heads 50 and 52 are introduced into enlarged regions 40 and 42 respectively, they enter support 32, and envelope 2 can be rotated with respect to base 32. This locks the lamp together and permits it to be threaded into a conventional socket. Should filament 6 burn out, envelope 2 may be detached by rotating it counterclockwise with respect to support 32 and pulling away. A device of this general type is disclosed in U.S. Pat. No. 4,256,989.

What is claimed is:

1. An energy-efficient incandescent lamp with improved filament characteristics, comprising:

an envelope, an incandescent filament mounted within said envelope for consuming power of a predetermined wattage and becoming incandescent to produce visible and infrared radiation;

means substantially surrounding said filament and having a coating thereon for transmitting a substantial portion of the visible radiation therethrough and out of the envelope and for reflecting a substantial portion of the infrared radiation back to a predetermined location of confined area within the envelope where the filament is intended to be located so that the infrared radiation will impinge upon said filament to raise its operating temperature; and means for supplying power at said predetermined wattage to said filament including a diode connected in series with the filament for rectifying an applied AC voltage to cause the filament to consume power of said predetermined wattage at a current greater than that of another filament designed to consume the same power without rectification of AC applied thereto and is of shorter length and greater thickness than said other filament thereby increasing the mechanical strength of said filament for better maintaining it at said predetermined location when the envelope is subjected to mechanical shock and vibration and decreasing its length to better conform to said confined area where said filament is intended to be located.

2. The lamp of claim 1 wherein the diode is a junction diode.

3. The lamp of claim 1 further comprising a base attached to said envelope, said base adapted for connection to a lamp fixture.

4. The lamp of claim 3 wherein the diode is located in the base.

5. The lamp of claim 4 wherein the base is detachably secured to the envelope.

6. The lamp of claim 3 wherein the characteristic of the diode is selected so that the diode acts as a fuse in response to a current higher than the rated operating current of the lamp.

7. The lamp of claim 1 further comprising means for supporting the filament at its ends at said predetermined location.

* * * * *